US011441310B2

(12) United States Patent
Förg et al.

(10) Patent No.: US 11,441,310 B2
(45) Date of Patent: Sep. 13, 2022

(54) WATER-DRAINING JOINT SEALING TAPE MADE OF FOAM FOR DIFFERENT PROFILE DIMENSIONS AND SEALING ARRANGEMENT COMPRISING SUCH A JOINT SEALING TAPE

(71) Applicant: Hilti Aktiengesellschaft, Schaan (LI)

(72) Inventors: Christian Förg, Buchloe (DE); Jekaterina Miller, Ostfildern (DE); Roland Weixler, Buchloe (DE); Mario Paetow, Landsberg am Lech (DE); Andreas Ober, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 17/274,800

(22) PCT Filed: Sep. 23, 2019

(86) PCT No.: PCT/EP2019/075492
§ 371 (c)(1),
(2) Date: Mar. 10, 2021

(87) PCT Pub. No.: WO2020/064613
PCT Pub. Date: Apr. 2, 2020

(65) Prior Publication Data

US 2022/0098854 A1 Mar. 31, 2022

(30) Foreign Application Priority Data

Sep. 25, 2018 (EP) ..... 18196506

(51) Int. Cl.
*E04B 1/68* (2006.01)
*E04B 1/94* (2006.01)
(Continued)

(52) U.S. Cl.
CPC ..... *E04B 1/6812* (2013.01); *E04B 1/948* (2013.01); *E04B 2/7411* (2013.01); *E06B 1/64* (2013.01)

(58) Field of Classification Search
CPC ..... E04B 1/6812; E04B 1/64; E04B 1/948; E04B 2/7411; E04F 19/022
See application file for complete search history.

(56) References Cited

U.S. PATENT DOCUMENTS 7,617,643 B2 11/2009 Pilz et al.
7,950,198 B2 5/2011 Pilz et al.
(Continued)

FOREIGN PATENT DOCUMENTS

EP 3 246 481 11/2017
WO 2009/026464 2/2009

OTHER PUBLICATIONS

International Search Report dated Dec. 4, 2019 in PCT/EP2019/075492 with English translation, 7 pages.
(Continued)

*Primary Examiner* — Paola Agudelo
(74) *Attorney, Agent, or Firm* — Grüneberg and Myers PLLC

(57) ABSTRACT

A water-draining joint sealing tape can be used universally for different profile dimensions, for sealing structural joints against sound and/or smoke and optionally against fire. A joint sealing tape for sealing a joint between a first component and a second component can include an elongate connecting element and at least two sealing elements which are positioned on the connecting element so as to be spaced apart next to one another and so as to extend in the longitudinal direction of the connecting element. The sealing elements and the connecting element can include a one piece open-cell, slow-burning foam and encased by a plastic film, which tape has at least one opening in the plastic film
(Continued)

on an underside of each sealing element. Furthermore, a water-draining sealing arrangement for sealing structural joints can be utilized.

20 Claims, 2 Drawing Sheets

(51) Int. Cl.
*E04B 2/74* (2006.01)
*E06B 1/64* (2006.01)

(56) References Cited

U.S. PATENT DOCUMENTS 11,136,767 B2 * 10/2021 Förg ..... E04B 1/8209
2003/0079425 A1 * 5/2003 Morgan ..... E04B 2/82 52/232
2004/0045234 A1 * 3/2004 Morgan ..... F16L 5/04 52/232
2009/0049777 A1 2/2009 Pilz et al.
2010/0115868 A1 * 5/2010 Shaw ..... E04B 1/948 52/396.01
2010/0126092 A1 5/2010 Pilz et al.
2011/0120038 A1 * 5/2011 Wormann ..... E04B 1/6812 52/309.4
2018/0002917 A1 * 1/2018 Kleinhans ..... E04B 2/7457
2018/0038100 A1 * 2/2018 Braunmueller ..... B29C 44/324
2018/0202147 A1 * 7/2018 Klein ..... E04B 2/822
2019/0153725 A1 * 5/2019 Foerg ..... E04B 1/948
2019/0316348 A1 * 10/2019 Pilz ..... E04B 1/947
2019/0376300 A1 * 12/2019 Förg ..... E04B 1/88
2020/0332525 A1 * 10/2020 Klein ..... E04B 1/94
2021/0017761 A1 * 1/2021 Klein ..... E04B 2/7411
2021/0146173 A1 * 5/2021 Förg ..... A62C 3/16
2021/0309887 A1 * 10/2021 Hulteen ..... E04F 21/1657

OTHER PUBLICATIONS

Written Opinion dated Dec. 4, 2019 in PCT/EP2019/0754492 with English translation, 9 pages.

* cited by examiner

WATER-DRAINING JOINT SEALING TAPE MADE OF FOAM FOR DIFFERENT PROFILE DIMENSIONS AND SEALING ARRANGEMENT COMPRISING SUCH A JOINT SEALING TAPE

CROSS-REFERENCE TO RELATED APPLICATIONS

This application is a National Stage entry under § 371 of International Application No. PCT/EP2019/075492, filed on Sep. 23, 2019, and which claims the benefit of European Application No. 18196506.2, filed on Sep. 25, 2018. The content of each of these applications is hereby incorporated by reference in their entirety.

FIELD OF THE INVENTION

The present invention relates to a joint sealing tape made of foam for different profile dimensions of a drywall framework for sealing structural joints, in particular for sealing against sound and smoke and optionally against fire, the joint sealing tape being water-draining. In particular, the invention relates to the acoustic, smoke-proof and/or fire-proof sealing of connection joints in drywalls, in particular expansion joints, the joint sealing tape being designed such that, despite being installed in an early construction phase, water retention—e.g. caused by rainwater—in the joint sealing tape is reduced, the passage of water/outlet of water is accelerated and complete drying of the joint sealing tape is ensured.

BACKGROUND OF THE INVENTION

Connection joints are usually formed when different building parts meet. Connection joints are located in the region of connection to the inter-story ceiling, to the floor and to solid walls. Due to weight loading or thermal influences, the ceiling in buildings may be forced upward or downward. To prevent damage to the drywall, the upper connection joint in this case is designed as an expansion joint. Expansion joints are therefore joints which interrupt components and prevent stress cracks. The ceiling profile is designed in such a way that a relative movement between the ceiling profile and the perpendicular wall components is possible.

In general, a U-profile which is part of the framework is fastened to the connection components. The gypsum boards themselves are attached at a defined spacing to the connection component. Usually the system is sealed in the gap between the gypsum board and the ceiling. For this purpose, either a suitable sealing compound is introduced or else the gap is filled with mineral wool and provided with a sealing layer on the surface. Sealing these joints using different foams and foam sealing tapes is also known, which ensures sufficient movement absorption.

In particular, sealing the gap using foams and foam sealing tapes has some disadvantages. In particular, if open-cell foams are used which are surrounded by a film and are installed at an early stage of construction, rainwater can come into contact with the product, since the facade is often not yet closed or water enters through openings in ceilings. When in contact with water, the foam can absorb the water and the outlet of the water is impaired by the surrounding film, which prevents the foam from drying quickly. Finally, damp seals can damage the building structure.

The object of the invention is therefore that of providing a joint sealing tape which reduces the retention/accumulation of rainwater when installed in an early construction phase, which in particular accelerates the passage of water/outlet of water and which ensures that the joint sealing tape dries completely—while having constant, effective sealing as soon as it is applied, outstanding impermeability at maximum expansion absorption and the ability to be used for different profile widths of the U-profile of a drywall framework.

A further object of the present invention is that of providing a water-draining arrangement which, in the event of fire, enables better sealing of the joint between two components, in particular between a drywall and a connection component such as a wall, a ceiling or a floor, and thus provides better and durable sealing against sound and/or smoke and optionally better and durable fire protection, and can be mounted reliably and without defects with little work effort, and which, despite being installed in an early construction phase, reduces water retention/water accumulation—caused by rainwater—in the joint sealing tape, accelerates the passage of water/outlet of water and ensures that the joint sealing tape dries completely.

This and further, which will become apparent from the following description of the invention, are solved by the present invention as described in the embodiments below. The below description includes further preferred embodiments.

SUMMARY OF THE INVENTION

The present invention relates to a joint sealing tape for sealing a joint between a first component and a second component, comprising an elongate connecting element and at least two sealing elements which are positioned on the connecting element so as to be spaced apart next to one another and so as to extend in the longitudinal direction of the connecting element, the sealing elements and the connecting element as one piece consisting of an open-cell, slow-burning foam and being encased by a plastic film, characterized in that there is at least one opening in the plastic film on an underside of each sealing element.

The present invention further relates to a sealing arrangement for sealing a joint between two adjacent components, comprising at least a first component, a second component and the joint sealing tape according to the invention.

Some other objects and features of this invention are obvious and some will be explained hereinafter. In particular, the subject matter of the present invention will be described in detail by reference to the following figures:

DETAILED DESCRIPTION OF THE INVENTION

Figure 1:
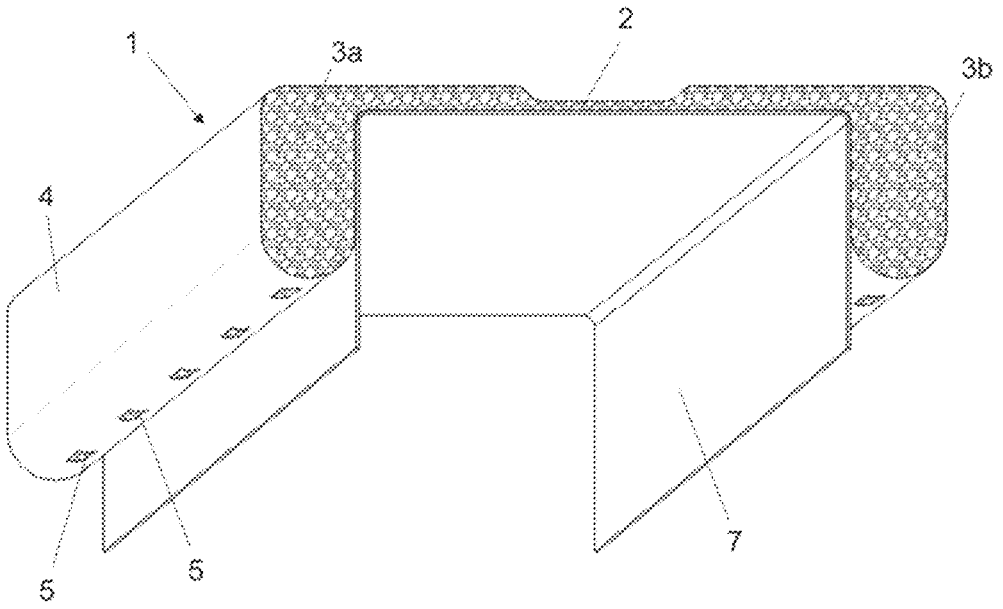
FIG. 1 shows a perspective front view of a joint sealing tape according to an embodiment of the present invention, on a profile carrier, the sealing elements having a solid foam profile and rectangular profile having rounded corners and being encased by a film and there being openings in the plastic film on an underside of each sealing element.

The following terms are used within the scope of the present invention:

Within the scope of the present invention, the term "geometries" comprises various cross section types and cross section shapes. This means that, in particular, the sealing elements can have different cross section types and cross section shapes. Cross section types are understood inter alia as round profile (round cross section), oval profile (oval cross section), polygonal profile (polygonal cross section), in particular square profile (square cross section), rectangular profile (rectangular cross section), parallelogram profile (cross section in the shape of a parallelogram), triangular profile (triangular cross section), etc. However, other or mixed cross section shapes are also conceivable and possible, such as a rectangular profile having rounded corners. Cross section shapes are understood inter alia as solid profile and hollow profile; solid profile means that the sealing elements consist completely of sealing material while hollow profile means that the sealing elements consist only partly of sealing material.

The terms "comprise", "with" and "have" are intended to be inclusive and mean that elements other than those cited may also be meant.

Within the scope of the present invention, the term "intumescence" means that, under the effect of heat, for example in the event of a fire, the material swells and forms an insulating layer of flame-retardant material, i.e. intumesces.

Within the scope of the present invention. "slow-burning foam" is understood as a foam which offers no possibility of fire spreading through the foam, is not inherently flammable and also does not drip.

"Positioned in the upper region of the joint" means that the sealing elements are in particular arranged laterally on the first component.

The terms "water-draining, water-conducting, water-outlet-conveying, water-passage-conveying and water-permeable" are synonymous in the sense of the present invention and are to be regarded as synonyms; they mean that water retention/water accumulation in the joint sealing tape is reduced or that the water does not remain in the joint sealing tape in the long term and may cause damage to the building structure.

As used within the scope of the present invention, the singular forms "a" and "an" also include the corresponding plural forms, unless something different can be inferred unambiguously from the context. Thus, for example, the term "a" is intended to mean "one or more" or "at least one", unless otherwise indicated.

In one aspect, the present invention relates to a water-draining joint sealing tape for sealing a joint between a first component and a second component, comprising an elongate connecting element and at least two sealing elements which are positioned on the connecting element so as to be spaced apart next to one another and so as to extend in the longitudinal direction of the connecting element, the sealing elements and the connecting element as one piece consisting of an open-cell, slow-burning foam and being encased by a plastic film, characterized in that there is at least one opening in the plastic film on an underside of each sealing element.

In a further aspect, the present invention relates to a water-draining sealing arrangement for sealing a joint between two adjacent components, comprising at least a first component, a second component and the above-described joint sealing tape, wherein the joint sealing tape is positioned in the upper region of the joint and is configured to seal the joint from the outside.

It has been discovered that the joint sealing tape according to the invention is particularly suitable for securely sealing, in a simple manner, a structural joint between two adjacent components, in particular against sound and/or smoke and optionally also against fire, and that the joint sealing tape can be used universally at the same time for different profile widths, in particular of a U-profile of a drywall framework. In addition, it has been found that openings on an underside of the sealing elements made of open-cell, slow-burning foam, despite being installed in an early construction phase, reduce water retention/water accumulation—caused by rainwater—in the joint sealing tape, accelerate the passage of water/outlet of water and ensure complete drying of the joint sealing tape.

So that the joint sealing tape can also be used for different U-profile widths, the connecting element of the joint sealing tape can have a perforation and/or have a widening element. In addition, it is advantageous that the sealing elements of the joint sealing tape have a predetermined geometry, in particular a rectangular profile having rounded corners.

Therefore, it is an object of the present invention to describe the water-draining joint sealing tape. Furthermore, it is an object of the present invention to describe the positioning of the joint sealing tape, in particular a water-draining sealing arrangement.

The water-draining joint sealing tape according to the invention for sealing a joint between a first component and a second component, comprising an elongate connecting element and at least two sealing elements which are positioned on the connecting element so as to be spaced apart next to one another and so as to extend in the longitudinal direction of the connecting element, the sealing elements and the connecting element as one piece consisting of an open-cell, slow-burning foam and being encased by a plastic film, is characterized in that there is at least one opening in the plastic film on an underside of each sealing element.

The at least one opening makes it possible for water retention/water accumulation, caused by rainwater on the construction site when the joint sealing tape is installed early and by contact with water through an open facade or openings in the ceiling, to be drained off. When using open-cell foams, the water is often sucked up and the water outlet is impaired by the surrounding film, which prevents the foam from drying quickly. The at least one opening in the plastic film on the underside of each sealing element reduces the water retention—caused by rainwater—in the joint sealing tape, and accelerates the passage of water/outlet of water and ensures that the joint sealing tape dries completely.

The openings can be in the form of a hole or slit, particularly preferably in the form of an angular or round hole. In a preferred embodiment, the at least one opening has a diameter in a range of from 1 to 10 mm, preferably from 3 to 7 mm, most preferably the diameter is 3 mm.

In a particularly preferred embodiment of the joint sealing tape, there are a plurality of openings on the underside of each sealing element at a distance from one another in the range of from 10 to 60 mm, preferably from 10 to 50 mm, most preferably from 15 to 40 mm.

The openings can be made in the underside of each sealing element by means of cutting, punching, slitting or lasering. In particular, lasering is preferred because it is a non-contact, precise method step which is used particularly in continuous production. In particular, lasering ensures that no material is removed and that there are no chippings and/or other forms of contamination in the production line and there is no material loss on the foam.

In one embodiment of the joint sealing tape, the connecting element has a perforation. The perforation of the connecting element preferably extends in the middle of the connecting element, i.e. in the longitudinal direction of the joint sealing tape. This perforation enables easy separation (tearing apart) or alternatively pulling apart of the two joint sealing tape halves. By being tom apart, without the use of tools, two separate joint sealing tape halves can be easily produced which each have a sealing element and which, by means of an adhesive device, such as a separate adhesive tape or adhesive spray, can be used either for a one-sided seal or for wider U-profiles, in particular U-profiles having profile widths of more than 10 inches (254 mm). It is also possible that the joint sealing tape is provided with self-adhesive devices before being separated such that two half tapes are formed after being tom apart which can be installed immediately without any additional aids. The joint sealing tape halves can therefore be used universally for different profile dimensions.

The sealing elements of the joint sealing tape according to the invention for sealing a joint between a first component and a second component have a predetermined geometry. As already mentioned above, geometries within the scope of the present invention comprise various cross section types and cross section shapes.

Preferred cross section types of the sealing elements according to the present invention are solid profile and hollow profile; the hollow profile may be a closed or open hollow profile. Solid profile and hollow profile having a large profile wall thickness have the advantage that there is automatically no gap at the abutment of two contacting sealing elements. Hollow profiles can be compressed to a greater extent and thus absorb more movement. It is particularly preferred that the sealing elements have a solid profile.

Preferred cross section shapes of the sealing elements according to the present invention are round profile and polygonal profile, in particular rectangular profile, square profile, oval profile, parallelogram profile and triangular profile. Round profile and rectangular profile are particularly preferred, but rectangular profile is the most preferred. However, other or mixed cross section shapes are also conceivable and possible, for example a rectangular profile having rounded corners, as long as the sealing elements adjoin the two components after the joint sealing tape has been installed and can close the joint which exists between the components. The sealing elements are preferably positioned on the outer edge of the connecting element.

In a preferred embodiment of the joint sealing tape according to the invention, the sealing elements have a round profile.

In a further preferred embodiment of the joint sealing tape according to the invention, the sealing elements have an oval profile.

In yet another preferred embodiment of the joint sealing tape according to the invention, the sealing elements have a rectangular profile having rounded corners.

In a particularly preferred embodiment of the joint sealing tape according to the invention, the sealing elements have a solid profile and a round profile.

In a further, particularly preferred embodiment of the joint sealing tape according to the invention, the sealing elements have a solid profile and an oval profile.

In a still further, particularly preferred embodiment of the joint sealing tape according to the invention, the sealing elements have a solid profile and a rectangular profile having rounded corners.

The geometry of the sealing elements can be prefabricated, for example by means of defined cutting to size, extruding or pressing of suitable sealing material. The production of such cross section types and cross section shapes is known to a person skilled in the art. Preferably the geometry of the sealing elements is prefabricated by defined cutting to size or extrusion. It is particularly preferred that the geometry of the sealing elements is produced by extrusion.

According to the invention, the sealing elements and the connecting element as one piece consist of an open-cell, slow-burning foam. Common foams such as polyethylene and polyurethane foams or cellular rubber can be indicated as foam material. The foam may be impregnated using an impregnating agent which increases the sealing properties of the foam. In order to achieve impermeability with respect to smoke, the open-cell sealing elements are encased by a plastic film.

It is advantageous if the cell sizes of the open-cell, slow-burning foam are in a range of from 0.1 to 10 mm, preferably from 0.2 to 5.0 mm, most preferably >0.3 mm.

It has proven advantageous when the sealing elements consist of a slow-burning foam, such as a cellular rubber or polyurethane foam. In the case of a slow-burning foam, there is no possibility of fire spreading through the foam. Inherent flammability is ruled out for the above-mentioned foam base materials. It is also advantageous that no dripping occurs in the event of fire. In a temperature range between 500° C. and 800° C., a slow-burning foam should still keep at least 20%, at least 25%, preferably at least 30%, between 20% to 60%, between 20% to 40%, preferably between 25% to 30% of its original volume. Furthermore, in a temperature range between 500° C. and 800° C., a slow-burning foam should still keep at least 10%, at least 20%, preferably at least 30%, between 10% to 40%, between 10% to 30%, preferably between 15% to 20% of its original mass.

Furthermore, the material may contain appropriate additives if fire protection properties such as intumescence, for example, are desired. Under the effect of heat, such as in the event of fire, the material swells and forms an insulating layer of flame-retardant material. A voluminous insulating layer, specifically an ash layer, can be formed by the chemical reaction of a mixture of compounds which are matched to one another and react with one another under the effect of heat. Systems of this kind are known to a person skilled in the art as chemical intumescence and can be used according to the invention. Alternatively, the voluminous insulating layer may be formed by swelling of an individual compound which releases gases under the effect of heat, without a chemical reaction between two compounds having taken place. Systems of this kind are known to a person skilled in the art as physical intumescence and can also be used according to the invention. The two systems can each be used according to the invention either alone or together as a combination.

In a particularly preferred embodiment of the joint sealing tape according to the invention, the open-cell, slow-burning foam consists of an intumescent polyurethane material.

In one embodiment of the joint sealing tape according to the invention, the sealing elements are rigidly connected to the connecting element at least over part of their circumference. This creates a rigid connection between the connecting element and the sealing elements, such that the sealing elements are prevented from completely detaching from the connecting element even when the fastening region is subjected to heavy loads and when the sealing elements are partly detached from the connecting element.

In a further embodiment of the joint sealing tape according to the invention, the sealing elements are rigidly connected to the connecting element over their entire circumference. In this way, optimal and permanent fastening of the sealing elements to the connecting element is achieved which makes detaching the sealing elements from the connecting element almost impossible.

In a particularly preferred embodiment of the joint sealing tape according to the invention, the sealing elements and the connecting element consist of an open-cell intumescent polyurethane material and are fully encased by a polyethylene film.

The region of the connecting element that lies between the two sealing elements, more precisely between the two points of contact of the connecting element with the sealing element, defines a support region which consists only of the connecting element. The support region is dimensioned such that it corresponds approximately to the width of the web of the U-profile. This facilitates the installation and in particular the positioning of the joint sealing tape on the web of the U-profile. It is preferred that the support region of the joint sealing tape according to the invention has a width in the range of from approximately 30 mm to approximately 300 mm, preferably in the range of from approximately 50 to 250 mm, and more preferably in the range of from approximately 90 to 155 mm. It is particularly preferred that the support region of the joint sealing tape according to the invention has a width of 67 mm for a 2½ inch (64 mm) rail, of 95 mm for a 3⅝ inch (92 mm) rail, of 105 mm for a 4 inch (102 mm) rail, of 155 mm for a 6 inch (152 mm) rail, of 206 mm for an 8 inch (203 mm) rail or of 257 mm for a 10 inch (254 mm) rail. It is most preferred that the support region of the joint sealing tape according to the invention has a width of 95 mm for a 3⅝ inch (92 mm) rail or of 155 mm for a 6 inch (152 mm) rail.

Figure 3:
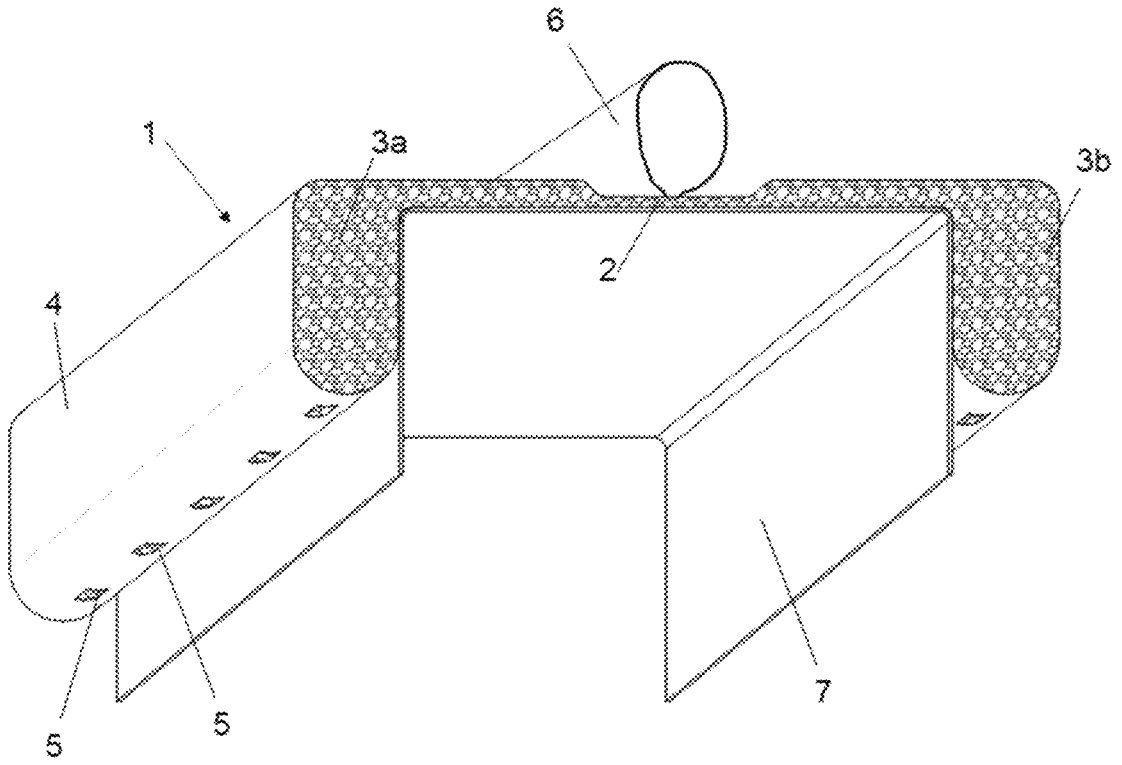
FIG. 3 shows a perspective front view of a joint sealing tape according to an embodiment of the present invention, on a profile carrier, the sealing elements having a solid foam profile and rectangular profile having rounded corners and being encased by a film and there being openings in the plastic film on an underside of each sealing element. A widening element is shown in the form of a loop. The widening element may be fastened to the upper side or underside of the connecting element.

In order to obtain different profile dimensions, in particular different widths of the support region, the connecting element of the joint sealing tape according to the invention can furthermore have at least one widening element 6. It is preferred that the widening element 6 is in the form of a loop, as shown in FIG. 3. Tile widening element consists of a deformable material, a plastic film, a woven fabric, a non-woven fabric or the like, preferably of a plastic film such as polyethylene.

This widening element is fastened to the upper side or underside of the connecting element such that a loop is formed. It is fastened by sewing, gluing or welding, preferably by welding. The dimensions of the loop are such that, after pulling apart the two joint sealing tape halves, the desired width for an alternative profile is created by cutting through the perforation of the connecting element. In this way, a second profile dimension can be obtained by a separation step, i.e. the joint sealing tape can be used simultaneously for a 3⅝ inch (92 mm) or 6 inch (152 mm) rail, for example.

Furthermore, the joint sealing tape according to the invention can have one or more additional widening elements in the form of loops. These additional widening elements can be obtained by dividing the loop of the at least one widening element one or more times using a weld seam such that a plurality of profile widths can be covered by one product by means of accordingly separating the seam or seams. In particular, the common U-profiles having profile widths of 2½ inches (64 mm), 3⅝ inches (92 mm), 4 inches (102 mm), 6 inches (152 mm), 8 inches (203 mm) and 10 inches (254 mm) can be covered by means of the one or more widening elements. This facilitates the installation and in particular the positioning of the joint sealing tape on the web of the U-profile. To facilitate the selection of the desired width of the joint sealing tape for a specific profile, the widening elements can be provided with markings for the specific profile sizes. Due to the flexibility of the widening element, however, it is also possible to cover other profile widths of U-profiles of a drywall framework with the joint sealing tape according to the invention and to seal the joint.

The joint sealing tape according to the invention provides a universal product for different profile sizes and applications that can also be produced inexpensively in a production line and is also water-draining.

The dimensions and the material of the joint sealing tape, in particular of the sealing elements and the connecting element, are selected according to the planned use of the joint sealing tape.

In general, the dimensions of the sealing elements are selected depending on the profile types and the material used. The dimensions must be chosen such that the joint sealing tape fills the gap between the gypsum board and the ceiling and sealingly abuts the ceiling and the gypsum board. If a vertical movement of the gypsum boards is to be permitted, the joint sealing tape must follow the movement of the gypsum board such that the contact with the gypsum board is not tom apart and no gaps are able to form between the sealing element and the gypsum board. For this purpose, the sealing element preferably consists of open-cell foam material and is appropriately pre-compressed during mounting of the gypsum board such that a downward movement of the gypsum board can be carried out, as a result of which the gap between this and the ceiling becomes larger. In this way, the pre-set freedom of movement of the gypsum board determines the dimensions of the sealing element.

The sealing elements can be positioned on a component in one step by means of a connecting element. It is also possible for the connecting element and/or the sealing elements in turn to have means for fastening to a component, such as a drywall profile, for example in the form of a self-adhesive layer, in the form of form-fittingly or frictionally acting means, such as suitable profiles or the like; optionally individual positioning of the sealing elements is also possible, for example if the joint sealing tape is separated at the perforation and two joint sealing tape halves are obtained. However, the joint sealing tape according to the invention is preferably positioned on a component in one step.

To create a water-draining sealing arrangement according to the invention, the joint sealing tape according to the invention is positioned on a first component before attaching the first component and then fastened together with said first component to a second component in a conventional manner, for example by screwing or nailing. Preferably, the first component is a frame profile of a drywall framework, for example a U-profile, and the second component is a wall, a ceiling or a floor of a building. Particularly preferably, the first component is a U-profile and the second component is a ceiling. In this arrangement, the joint sealing tape is positioned in the upper region of the joint and is configured to seal the joint from the outside.

In one possibility for sealing a connection joint in dry construction, the joint sealing tape is positioned on a U-profile before the profile is attached to the connection components, such as a ceiling, and then fastened together with this to the ceiling. In a further operation, the gypsum boards, whether they have one or two layers, are pressed against the sealing element at the end face, such that, in the case of a double-boarded arrangement, the two gypsum boards come into contact with the sealing element by means of their upper edge in each case, thus sealing the joint. In order to permit movement of the gypsum board(s) without the formation of a gap between the sealing element and the gypsum board or the gypsum boards in the case of maximum movement, the sealing element must be compressed during mounting of the gypsum board(s).

For this purpose, the material and the thickness of the sealing element are each chosen such that the sealing element does not hinder the movement of the gypsum board(s) and, at maximum joint width, the upper edge of the gypsum board(s) still remains in contact with the sealing element in order to ensure adequate sealing against gases. The width of the sealing element is preferably selected such that it corresponds approximately to twice the width of one gypsum board. It has been found that sufficient sealing may also be achieved when the width of the sealing element corresponds to the width of only one gypsum board.

When the joint sealing tape is arranged on the U-profile and abuts the ceiling, unevenness in the two components can be compensated for and simple positioning without gluing is possible. Furthermore, the joint spacing can be controlled by the subsequent positioning of the gypsum board as well as by the selection of sealing materials and/or geometric configuration of the joint sealing tape.

Alternatively, when only one gypsum board is used, it may be mounted not from underneath in a manner abutting the sealing element, but instead in such a way that the gypsum board partly overlaps the sealing element. Thereby the gypsum board partly projects over the sealing element, and the overlapping part of the sealing element is pressed between the U-profile and the gypsum board. It has been found that sufficient sealing can also be achieved hereby, especially against gases. To improve the impermeability and/or the sliding properties, the sealing tape may be laminated on one side with a layer of a material, such as a plastic film, which neither hinders the movement of the gypsum board nor is destroyed by it. As an example, the positioning marking for the gypsum board may be easily applied on a film.

In this type of mounting, a large capacity for absorbing movement relative to the joint width is possible. Furthermore, this type is more mounting-friendly than the aforementioned single-boarded or double-boarded arrangement, since the gypsum board can be mounted simply on the sealing element without the need to measure the spacing. If positioning marking is used, the gypsum board can be mounted without the need to measure the spacing. Above and beyond this, there is no need to use readily compressible materials for the sealing elements in this type of mounting, thus permitting relatively broad freedom in the choice of material.

In a further particularly preferred alternative, sealing of the joint can be achieved when, in the case of a double-boarded arrangement, the two gypsum boards are mounted at a horizontal offset in such a way that the outer of the two gypsum boards (also referred to as the outer, second gypsum board) is mounted higher (i.e. closer to the ceiling) than the inner gypsum board (also referred to as the inner, first gypsum board). In this embodiment, the thickness of the sealing element is chosen to correspond to the thickness of one gypsum board. The first, inner gypsum board is mounted in such a way that its upper edge contacts the end faces of the sealing element, in which case zero or little pre-compression of the sealing element is necessary. The second, outer gypsum board is attached at a horizontal offset, i.e. it is mounted higher than the first, inner gypsum board, such that it partly overlaps the sealing element. In this case the sealing element and the gypsum board should abut one another sealingly in order to seal the gap between the outer, second gypsum board and the sealing element, in particular against gases. Thus, sealing is achieved between the sealing element and the second component, such as a ceiling, a wall or a floor, and between the sealing element and the outer, second gypsum board.

An empty gap remains between the second component, such as a ceiling, a wall or a floor, and the outer, second gypsum board. In the case of a vertical movement of the second component or of the gypsum boards, this gap is completely capable of absorbing movement.

Depending on how far the outer, second gypsum board overlaps the sealing element (size of the offset), a movement in the other direction may also be absorbed. In this case, it is important that an overlap is still ensured between the second gypsum board and the joint sealing tape. Preferably, therefore, the dimensions of the sealing element are chosen such that its thickness is somewhat larger than the thickness of one gypsum board and its height covers somewhat more than the maximum permissible movement of the components (maximum joint width).

On account of the fact that the thickness of the sealing element is greater than the thickness of the gypsum board, the gypsum board is pressed against the sealing element and somewhat compressed while it is being mounted, as a result of which the gap between the sealing element and the gypsum board is reliably sealed, in particular against gases.

For easier setting of the correct joint dimensions in the outer, second gypsum board, markings referred to as positioning marking may be made laterally on the joint sealing tape. To improve the impermeability and/or the sliding properties, the sealing tape may be laminated on one side with a layer of a material, such as a plastic film, which neither hinders the movement of the gypsum board nor is destroyed by it. As an example, the positioning marking for the outer, second gypsum board may be easily applied on a film.

In this type of mounting, maximum absorption of movement relative to the joint width is possible. Furthermore, this type is very mounting-friendly, since firstly the first gypsum board can be mounted simply on contact with the sealing element without the need to measure the spacing. Secondly, especially if positioning marking is used, the second gypsum board can also be mounted without the need to measure the spacing. Furthermore, the broadest possible freedom in the choice of material for the sealing elements is achieved by this type of mounting, since these are compressed only slightly and thus only minor requirements are imposed on the compressibility of the sealing element.

According to the invention, the joint sealing tape can be used on all kinds of connection joints in which one component meets another component. Accordingly, the joint sealing tape may be used on all profiles, even closed profiles or wooden beams, which must be sealed at a connection surface. In particular, the joint sealing tape can also be used for sealing trapezoidal/corrugated metal sheets or for sealing from floor to wall, where they enable improved drying in particular.

A particularly preferred application of the joint sealing tape therefore relates to the sealing of profiles in dry construction, the first component being a ceiling, floor or wall profile or a metal or wood framework of a dry construction element, and the second component being a floor, a ceiling or a wall of a building element, for example a masonry structure or concrete building element. The profile may be any of the profiles commonly used for dry construction, regardless of whether it has a slitted or non-slitted web or slitted or non-slitted flange. The further components are gypsum boards which closely abut the profiles and are fastened to the framework. In order to permit vertical movement of the gypsum boards, for example in the event of an earthquake, the gypsum boards are mounted so as to be vertically movable at a spacing from a wall, a floor or a ceiling. Thereby a gap (also referred to as joint herein) is formed between the gypsum board and the wall, the floor or the ceiling. This joint is filled by the sealing element of the joint sealing tape such that the sealing element seals the joint against sound and/or smoke and, depending on material of the joint sealing tape, optionally also against fire.

Without restricting the scope of protection of the invention, the invention will be described in more detail on the basis of special embodiments of the joint sealing tape. In these embodiments, the joint sealing tape is applied to the connection joints in drywalls. It is clear to a person skilled in the art that the sealing tape may also be applied to structural joints of other types.

FIG. 1 shows a perspective front view of a preferred embodiment of a joint sealing tape 1 according to the invention on a profile carrier 7. The joint sealing tape 1 in FIG. 1*a* has two sealing elements 3*a* and 3*b* which are positioned on the outer edges of the connecting element 2. The sealing elements 3*a* and 3*b* have a rectangular profile having rounded corners and a solid profile, the connecting element 2 being positioned laterally on the sealing elements 3*a* and 3*b*. Furthermore, the sealing elements 3*a* and 3*b* and the connecting element 2 are made in one piece and consist of an open-cell, slow-burning foam which may contain fire protection additives. The joint sealing tape 1 is fully encased by a plastic film 4 and optionally has a perforation (P) in the longitudinal direction of the joint sealing tape 1 (not shown). On the underside of each sealing element 3*a* and 3*b* there are openings 5 in the form of lasered holes in the plastic film 4.

Figure 2:
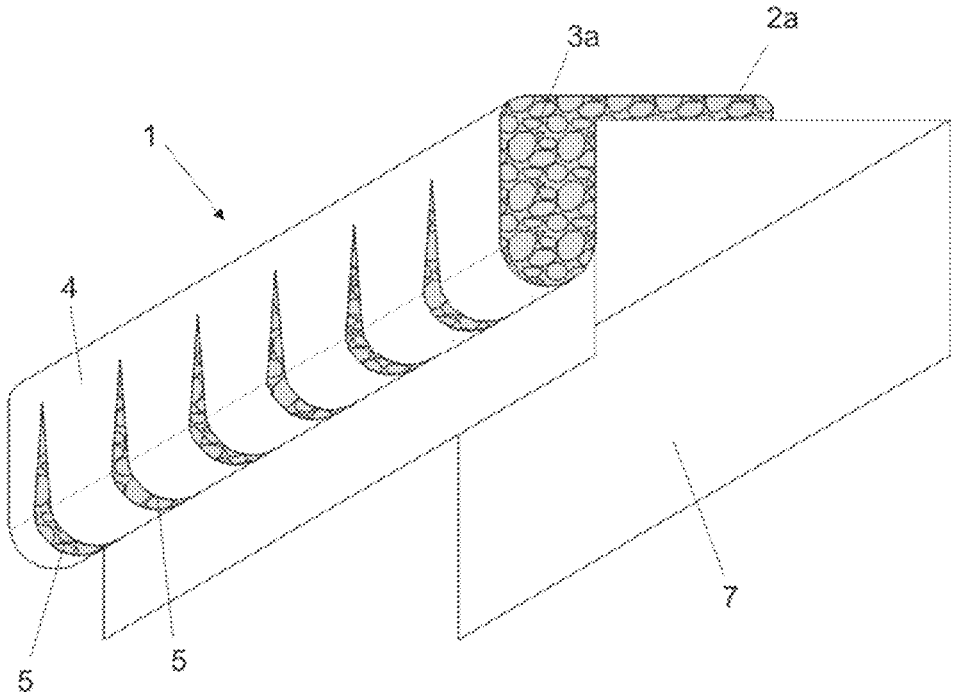
FIG. 2 shows a perspective front view of a joint sealing tape according to a further embodiment of the present invention, on a profile carrier, the joint sealing tape having been separated at its perforation, and the sealing element having a solid foam profile and rectangular profile having rounded corners and being encased by a film and there being openings in the form of slits in the plastic film on the underside of the sealing element.

FIG. 2 shows a perspective front view of a joint sealing tape according to a further embodiment of the present invention, on a profile carrier, the joint sealing tape having been separated at its perforation and the sealing element having a solid foam profile and rectangular profile having rounded corners and being encased by a film, and there being openings in the form of slits in the plastic film on the underside of the sealing element. After separation, the two joint sealing tape halves each have a sealing element 3*a* or 3*b* (not shown), each have a part 2*a* or 2*b* (not shown) of the connecting element 2 and are each partly encased by plastic film 4. On the underside of the sealing element 3*a* there are openings 5 in the form of slits made in the plastic film 4.

Rain Tests on the Cut Edge of the Joint Sealing Tape:

Test procedure: The end face of the joint sealing tape is subjected to a water flow (0.5 l/min) for at least 24 hours. The water absorption g/time is then measured via the increase in weight, the water spread over the horizontal cm/time is checked using a building moisture sensor, and the water release is measured after an observation period >7 days by means of drying (water release=drying g/time).

Openings in the film at the lower position (underside of the sealing element) positively influenced all of the above parameters. It was observed that the openings have a certain opening size; ideally approximately a diameter of at least 1 mm, preferably 3 mm, is advantageous. The distance between the openings should not be greater than 60 mm, preferably in the range of from 10-40 mm. A slit-like opening sometimes shows even better results with regard to water spread, since the path of the water is extended. This interrupts the suction effect in the case of hydrophobic foams. The expansion by means of capillary forces is also interrupted. Ideally, these measures are combined with a hydrophobic foam and/or an open-cell foam having the largest possible pores. The cell sizes more or less influence the water drainage. The best results in this context were achieved using cell sizes of the open-cell foam material of >0.3 mm. The cell stabilizers used also had advantageous effects that can influence the cell sizes and the nature of the cell wall as well as the cell structure and hydrophobic foam properties.

Rain tests have shown that the joint sealing tape according to the invention absorbs less water, that a balance between water absorption at the cut edge and water discharge via the drainage openings is established very quickly, that the openings cause a smaller and shorter horizontal spread of the water, that the joint sealing tape has significantly better drying behavior and that air contained in the joint sealing tape can very easily escape from the foam when installing the gypsum boards and that ultimately, if the foam has sucked up water, it can be very simply conveyed out since the water can drain off at any point.

As is obvious from the above explanations, the water-draining joint sealing tape according to the invention is particularly suitable for securely sealing, in a simple manner, a structural joint between two adjacent components, in particular against sound and/or smoke and optionally also against fire and can be used universally at the same time for different profile widths. In particular, it has been shown that the according to the invention ensures acoustic, smoke-proof and/or fire-proof sealing of connection joints in drywalls, in particular expansion joints, and that, despite being installed in an early construction phase, water retention/water accumulation—caused by rainwater—in the joint sealing tape is reduced, the passage of water/outlet of water is accelerated and complete drying of the joint sealing tape is ensured.

In addition, the joint sealing tape according to the invention can be used universally for different profile widths of a U-profile of a drywall framework, in particular for the usual profile widths of 2½ inches (64 mm), 3⅝ inches (92 mm), 4 inches (102 mm), 6 inches (152 mm), 8 inches (203 mm) and 10 inches (254 mm). The joint sealing tape according to the invention provides a universal product for different profile sizes and applications that can also be produced inexpensively in a production line.

Furthermore, application is very mounting-friendly, since no additional fastening of the joint sealing tape, for example to the profile or to the ceiling, is necessary. Due to the self-centering of the joint sealing tape when mounting the profile on a component, precise fitting of the joint sealing tape to a profile, for example, is also not necessary. Mounting is therefore conceivably easy, and the working effort for mounting the joint sealing tape is greatly reduced. The invention therefore achieves secure and reliable sealing of joints between two components, in particular between a profile of a drywall framework and an adjoining component, such as a ceiling, wall or floor. In this connection, two-sided sealing can be achieved in only one operation by providing a prefabricated sealing element.

Furthermore, it has been shown that outstanding impermeability can be achieved using the joint sealing tape according to the invention, since good compressibility of the sealing elements is ensured by the choice of the sealing materials and/or geometric configuration without additional aids. By appropriately selecting the sealing materials and/or geometric configuration, the invention also makes it possible to set the correct spacing between the gypsum board and the connection component without additional aids in order to achieve said pre-compression.

Furthermore, using the joint sealing tape according to the invention, unevenness of a component surface can be securely sealed as soon as one component is arranged on another component, since the sealing elements of the joint sealing tape are pressed sufficiently firmly against the surface of one component and at the same time against the lateral surfaces of the other component.

In view of the aforementioned, it is obvious that the objects of the invention have been solved. Since various modifications can be made to the joint sealing tape described above, without departing from the scope of the invention, it is intended that all subject matter contained in the above description be interpreted as illustrative and not in a restrictive sense.

The invention claimed is:

1. A joint sealing tape for sealing a joint between a first component and a second component, comprising:

an elongate connecting element, at least two sealing elements which are positioned on the connecting element so as to be spaced apart next to one another and so as to extend in the longitudinal direction of the connecting element, and the at least two sealing elements and the connecting element as one piece consisting of an open-cell, slow-burning foam and being encased by a plastic film, wherein there is at least one opening in plastic film on an underside of each sealing element.

2. The joint sealing tape according to claim 1, wherein the connecting element has a perforation.

3. The joint sealing tape according to claim 1, wherein the at least two sealing elements are positioned on the outer edge of the connecting element.

4. The joint sealing tape according to claim 1, wherein the at least two sealing elements are rigidly connected to the connecting element at least over part of their circumference.

5. The joint sealing tape according to claim 1, wherein the at least two sealing elements have a round profile, oval profile or a rectangular profile having rounded corners.

6. The joint sealing tape according to claim 1, wherein the open-cell, slow-burning foam comprises an intumescent polyurethane material.

7. The joint sealing tape according to claim 1, wherein the at least two sealing elements and the connecting element consist of an open-cell intumescent polyurethane material and are fully encased by the plastic film and wherein the plastic film comprises a polyethylene film.

8. The joint sealing tape according to claim 1, wherein the connecting element further comprises at least one widening element.

9. The joint sealing tape according to claim 8, wherein the at least one widening element is in the form of a loop.

10. The joint sealing tape according to claim 8, wherein the widening element consists of a deformable material, a plastic film, a woven fabric, or a non-woven fabric.

11. The joint sealing tape according to claim 1, wherein the at least one opening has a diameter in a range of from 1 to 10 mm.

12. The joint sealing tape according to claim 1, wherein a plurality of the at least one openings are arranged on the underside of each sealing element at a distance from one another in the range of from 10 to 80 mm.

13. The joint sealing tape according to claim 1, wherein the at least one opening is a hole or a slit.

14. The joint sealing tape according to claim 1, wherein a support region which is between two points of contact of the connecting element on the at least two sealing elements has a width in the range of from approximately 30 mm to approximately 300 mm.

15. A sealing arrangement for sealing a joint between two adjacent components, comprising:

at least a first component, a second component, and a joint sealing tape according to claim 1, wherein the at least two sealing elements are positioned in an upper region of the joint, and are configured to seal then joint from the outside.

16. The sealing arrangement according to claim 15, wherein the at least two sealing elements are arranged laterally on the first component.

17. The sealing arrangement according to claim 15, wherein the first component is a frame profile of a drywall and the second component is a wall, a ceiling or a floor, of a building.

18. The joint sealing tape according to claim 1, wherein a support region which is between two points of contact of the connecting element on the at least two sealing elements has a width in the range of from approximately 50 to 250 mm.

19. The joint sealing tape according to claim 1, wherein a support region which is between two points of contact of the connecting element on the at least two sealing elements has a width in the range of from approximately 90 to 155 mm.

20. A sealing arrangement for sealing a joint between two adjacent components, comprising:

at least a first component, a second component and a joint sealing tape according to claim 1, wherein the at least two sealing elements are positioned in an upper region of the joint, on the first component, and are configured to seal the joint from the outside.

* * * * *